United States Patent [19]

Grantham et al.

[11] Patent Number: 4,741,866

[45] Date of Patent: May 3, 1988

[54] PROCESS FOR DISPOSING OF RADIOACTIVE WASTES

[75] Inventors: LeRoy F. Grantham, Calabasas; Richard L. Gay, Canoga Park; Lowell R. McCoy, Woodland Hills, all of Calif.

[73] Assignee: Rockwell International Corporation, El Segundo, Calif.

[21] Appl. No.: 907,428

[22] Filed: Sep. 15, 1986

[51] Int. Cl.[4] ..... G21F 9/32; G21F 9/08; G21F 9/30; F23G 5/12

[52] U.S. Cl. ..... 252/632; 34/39; 110/237; 110/224; 110/342; 110/346; 159/47.3; 159/DIG. 12; 252/628

[58] Field of Search ..... 252/632, 629, 628, 626; 110/237, 216, 238, 224, 342, 346, 348; 34/10, 5, 7 R, 39, 40; 159/48.1, 47.3, DIG. 12

[56] References Cited

U.S. PATENT DOCUMENTS

| | | | |
|---|---|---|---|
| 4,008,171 | 2/1977 | Tiepel et al. | 252/632 |
| 4,053,432 | 10/1977 | Tiepel et al. | 252/632 |
| 4,268,409 | 5/1981 | Ga et al. | 252/628 |
| 4,290,907 | 9/1981 | Horiuchi et al. | 252/632 |
| 4,314,877 | 2/1982 | Queiser et al. | 252/632 |
| 4,350,620 | 9/1982 | Hartinger et al. | 252/628 |
| 4,405,512 | 9/1983 | Filter et al. | 252/628 |
| 4,481,134 | 11/1984 | Angelini et al. | 252/628 |
| 4,499,833 | 2/1985 | Grantham | 252/632 |
| 4,526,712 | 7/1985 | Hirano et al. | 110/237 |
| 4,559,170 | 12/1985 | Gay et al. | 252/628 |
| 4,566,204 | 1/1986 | Friesner et al. | 252/632 |
| 4,569,787 | 2/1986 | Horiuchi et al. | 252/632 |
| 4,579,069 | 4/1986 | Gay et al. | 110/342 |

*Primary Examiner*—John F. Terapane
*Assistant Examiner*—Howard J. Locker
*Attorney, Agent, or Firm*—H. Fredrick Hamann; Harry B. Field; David C. Faulkner

[57] ABSTRACT

Ion exchange resin wastes are prepared for disposal by dewatering and/or dehydrating the resins, sealing the pores and recovering the ion exchange resins having radioactive waste products trapped within the sealed pores.

12 Claims, No Drawings

PROCESS FOR DISPOSING OF RADIOACTIVE WASTES

BACKGROUND OF THE INVENTION

1. Technical Field

This invention relates to waste management and, more particularly, to a process for the disposal of radioactive waste products contained within spent ion exchange resin beads. Once the radioactive waste products or radionuclides are sealed within the resin beads disposal thereof is facilitated.

2. Background Art

Waste management frequently involves the necessity of disposing of large volumes of materials, some of which may be contaminated with hazardous substances. In nuclear power plants, for example, those utilizing pressurized water reactors and the like, ion exchange resins are used to purify the water in the primary loop of the reactor. After a period of time, the ion exchange resin becomes contaminated with radioactive contaminants and must be disposed of.

Disposal of radioactive wastes, in general, cannot be readily accomplished by using conventional waste disposal techniques because of the relatively long half-lives of certain radioactive elements. The most widely used disposal techniques for radioactive wastes are storage, solidification, and burial. The cost of so disposing of large volumes of radioactive wastes, however, is constantly rising and approaching levels at which volume reduction becomes economically desirable.

Many different methods for disposing of radioactive wastes are known. In U.S. Pat. No. 4,481,134, dated Nov. 6, 1984, microspheres containing nuclear waste can be made by an internal gelation process in which droplets of a chilled feed broth containing the waste, matrix components, urea and hexamethylenetetramine (HMTA) are fed to a heated immiscible gelation liquid, the droplets being gelled as they sink in the liquid by ammonia produced from the decomposition of the HMTA. Thereafter, the microspheres are dried and calcined to arrive at a desired uniform microsphere mass acceptable for subsequent disposal.

In U.S. Pat. No. 4,579,069, dated Apr. 1, 1986, and assigned to the assignee of the present invention, there is disclosed a process for reducing the volume of low-level radioactive wastes by removing the free water contained in the waste by means of spray drying at a temperature sufficient to vaporize the water contained in the waste but insufficient to oxidize the waste or to volatilize any radionuclides present in the waste.

However, to date no process has been found to accomplish volume reduction and make possible the safe disposal of spent ion exchange resin wastes of various types without completely destroying the ion exchange resins or encapsulating same for subsequent disposal.

It is accordingly an object of this invention to provide a process which is capable of reducing the volume and weight of ion exchange resin beads without oxidizing, combusting or interfusing same.

Another object of this invention is to provide a process for sealing radioactive waste products within the resins.

Yet another object of this invention is to provide a cost effective process for safely disposing of bead ion exchange resin wastes.

Other objects and advantages of this invention will become apparent in the course of the following detailed description.

DISCLOSURE OF INVENTION

In general, the present invention provides a process for trapping radioactive or radionuclide waste products within the pores of spent ion exchange resins including bead resins (300–1000$\mu$) and powered resins (5–100$\mu$). The process consists essentially of the sequential steps of:

(1) sealing the pores of the ion exchange resins and trapping radionuclide wastes within the sealed pores; and (2) recovering the ion exchange resins having radionuclide waste products trapped within the sealed pores of the spent ion exchange resins.

A dry, flowable radioactive solid product is thereby produced, which is reduced in weight and volume and the radioactive waste products are effectively encased in a sealed polymeric sphere and isolated from the biosphere indefinitely.

The dry, flowable spent ion exchange resin beads having the radioactive waste sealed within the beads may be disposed of by conventional means such as storage, burial, or incorporation into a solid matrix such as a ceramic, asphaltic, polymeric or concrete monolith prior to storage or burial.

DETAILED DESCRIPTION

The process of the present invention accomplishes volume reduction and makes possible the safe disposal of ion exchange resin wastes including bead resins (300–1000$\mu$) and powdered resins (5–100$\mu$). In particular, low-level radioactive wastes containing ion exchange resins having activities within the range of less than about 0.01 to about 500 $\mu Ci/cm^3$ can be treated in accordance with the process of this invention. Such ion exchange resin wastes may contain any one or several of the radioactive isotopes frequently encountered in the wastes of nuclear power plants, principally isotopes of Cs, Co, or I, especially $Cs^{134}$, $Cs^{137}$, $Co^{58}$, $Co^{60}$ or $I^{129}$, as well as other commonly encountered radioactive isotopes.

In the case of bead and powdered resins, substantially all of the interstitial water between the resin particles, the water on the surface of the ion exchange resin particles and the water inside the pores of the particles is removed during the process of sealing the pores and trapping radionuclide wastes inside.

In the process of this invention, ion exchange resins may be initially treated by introducing them into a drying zone or oven. The beads may be introduced as a finely atomized spray and the zone heated by means of a hot gas. Alternatively, the resins may be housed in a suitable container, such as a 50-gallon drum, and introduced into a drying oven for treatment.

The particular process consists essentially of the sequential steps of:

(1) dewatering or removing the interstitial and surface water of the ion exchange resin particles;

(2) dehydrating remaining surface and pore water;

(3) sealing the pores of the ion exchange resins and trapping radionuclide wastes within the sealed pores of the resin particles or beads; and (4) recovering the ion exchange resins having radionuclide products trapped within the sealed pores of the spent ion exchange resins.

In the dewatering step noted above, water may be initially removed mechanically such as by passing the resin particles over a mesh screen. Alternatively, the ion exchange resin waste may be thermally dehydrated by dispersing the ion exchange resin waste in an oven or drying zone for a residence time of from about 3 seconds to about 12 seconds and at a temperature in the range of from about 200° C. to about 450° C. This time and temperature controlled dehydrating step will vaporize the water (including residual water) on the surface of the resin particles and will also remove or drive off the water inside the ion exchange resin particles. The dehydrating step is, however, purposefully insufficient to oxidize or combust the ion exchange resin waste, nor will the pores be sealed during this step.

The pores of the ion exchange resins are sealed by stabilizing the temperature of the heating zone or oven at from about 100° C. to about 150° C. and maintaining that temperature for from about 46 hours to about 610 hours which effectively seals the pores of the resins while avoiding any fusing thereof.

Cooling of the resins to ambient or room temperature results in the production of a dry, flowable solid containing the radioactive contaminants which are encased or sealed within the resin particles and thus are effectively isolated from the biosphere indefinitely.

While the process detailed above indicates that dewatering (removal) and thermal dehydration of the resins is preferred, it is to be understood that neither the preparatory dewatering step nor the dehydration step is required.

The following Tables I–IV further illustrate the volume and weight reduction realized by the process of the present invention for various cation and anion exchange resins.

TABLE I

| | Cation Exchange Resin (H+)* | | | | | | |
|---|---|---|---|---|---|---|---|
| | Dewatering | Dehydration | | Sealing | | | |
| Test No. | Initial Dewatered Volume (cc) | Waste Dried Volume (cc) | Initial Waste Dried Weight (gm) | Treatment Temperature (°C.) | Treatment Time (hrs.) | Final Volume (cc) | Final Weight (gm) |
| 1. | 32.8 | 16.4 | 12.08 | 120° | 46.0 | 12.2 | 9.28 |
| 2. | 32.8 | 16.4 | 12.08 | 120° | 146.0 | 11.3 | 8.78 |
| 3. | 32.8 | 16.4 | 12.08 | 120° | 300.0 | 11.1 | 8.74 |
| 4. | 32.8 | 16.4 | 12.08 | 120° | 610.0 | 10.9 | 8.70 |

*IRN 77 (Trademark of Epicor Inc.)

TABLE II

| | Cation Exchange Resin* (Na+) | | | | | | |
|---|---|---|---|---|---|---|---|
| | Dewatering | Dehydration | | Sealing | | | |
| Test No. | Initial Dewatered Volume (cc) | Waste Dried Volume (cc) | Initial Waste Dried Weight (gm) | Treatment Temperature (°C.) | Treatment Time (hrs.) | Final Volume (cc) | Final Weight (gm) |
| 1. | 27.6 | 13.8 | 12.48 | 120° | 46.0 | 10.8 | 9.43 |
| 2. | 27.6 | 13.8 | 12.48 | 120° | 146.0 | 10.6 | 9.34 |
| 3. | 27.6 | 13.8 | 12.48 | 120° | 300.0 | 10.4 | 9.34 |
| 4. | 27.6 | 13.8 | 12.48 | 120° | 610.0 | 10.3 | 9.32 |
| 5. | 24.2 | 12.1 | 11.02 | 120° | 46.0 | 10.3 | 8.74 |
| 6. | 24.2 | 12.1 | 11.02 | 120° | 146.0 | 9.8 | 8.61 |
| 7. | 24.2 | 12.1 | 11.02 | 120° | 300.0 | 9.7 | 8.61 |
| 8. | 24.2 | 12.1 | 11.02 | 120° | 610.0 | 9.6 | 8.58 |

*IRN 77 (Trademark of Epicor Inc.)

TABLE III

| | Anion Exchange Resin (OH−)** | | | | | | |
|---|---|---|---|---|---|---|---|
| | Dewatering | Dehydration | | Sealing | | | |
| Test No. | Initial Dewatered Volume (cc) | Waste Dried Volume (cc) | Initial Waste Dried Weight (gm) | Treatment Temperature (°C.) | Treatment Time (hrs.) | Final Volume (cc) | Final Weight (gm) |
| 1. | 27.8 | 13.9 | 8.74 | 120° | 46.0 | 13.1 | 7.91 |
| 2. | 27.8 | 13.9 | 8.74 | 120° | 146.0 | 12.0 | 7.68 |
| 3. | 27.8 | 13.9 | 8.74 | 120° | 300.0 | 11.7 | 7.64 |
| 4. | 27.8 | 13.9 | 8.74 | 120° | 610.0 | 11.5 | 7.61 |

**IRN 78 (Trademark of Epicor Inc.)

TABLE IV

| | Anion Exchange Resin** (Cl−) | | | | | | |
|---|---|---|---|---|---|---|---|
| | Dewatering | Dehydration | | Sealing | | | |
| Test No. | Initial Dewatered Volume (cc) | Waste Dried Volume (cc) | Initial Waste Dried Weight (gm) | Treatment Temperature (°C.) | Treatment Time (hrs.) | Final Volume (cc) | Final Weight (gm) |
| 1. | 23.0 | 11.5 | 7.79 | 120° | 46.0 | 9.6 | 6.40 |
| 2. | 23.0 | 11.5 | 7.79 | 120° | 146.0 | 9.3 | 6.30 |
| 3. | 23.0 | 11.5 | 7.79 | 120° | 300.0 | 9.1 | 6.29 |
| 4. | 23.0 | 11.5 | 7.79 | 120° | 610.0 | 9.0 | 6.27 |
| 5. | 42.4 | 21.2 | 14.30 | 120° | 46.0 | 17.9 | 11.88 |
| 6. | 42.4 | 21.2 | 14.30 | 120° | 146.0 | 16.9 | 11.67 |

TABLE IV-continued

| | Anion Exchange Resin** (Cl−) | | | | | | |
|---|---|---|---|---|---|---|---|
| | Dewatering | Dehydration | | Sealing | | | |
| Test No. | Initial Dewatered Volume (cc) | Waste Dried Volume (cc) | Initial Waste Dried Weight (gm) | Treatment Temperature (°C.) | Treatment Time (hrs.) | Final Volume (cc) | Final Weight (gm) |
| 7. | 42.4 | 21.2 | 14.30 | 120° | 300.0 | 16.4 | 11.65 |
| 8. | 42.4 | 21.2 | 14.30 | 120° | 610.0 | 16.0 | 11.60 |

**IRN 78 (Trademark of Epicor Inc., 1375 E. Linden Avenue, Linden, N.J.)

While the principle, preferred embodiment has been set forth, it should be understood that within the scope of the appended claims, the invention may be practiced otherwise than as specifically described.

What is claimed is:

1. A process for removing water from the pores of spent, contaminated radioactive ion exchange resins and encasing radionuclides entrapped within the pores of said resins, the process consisting essentially of the sequential steps of:

(a) heating said spent ion exchange resins at a temperature of from about 100° C. to about 150° C. to remove water from within and fill the pores of the ion exchange resins by heating said ion exchange resins for from about 46 to about 610 hours at a temperature at which the pores of the resins are sealed while avoiding any fusing or melting of the ion exchange resins to encase radionuclides contained within the resins; and (b) cooling the resins to obtain dry, flowable ion exchange resins having radionuclides encased within sealed polymeric spheres.

2. The process of claim 1 which further includes the step of dewatering interstitial and surface water of the ion exchange resins.

3. The process of claim 1 further including the step of hydrating residual surface and pore water of the ion exchange resins.

4. The process of claim 2 in which the dewatering step consists essentially of mechanically removing interstitial and surface water.

5. The process of claim 3 in which the dehydrating step consists essentially of:

(a) introducing spent, contaminated radioactive ion exchange resins into a drying zone and heating the resins to a temperature which vaporizes residual surface water and water inside pores of the ion exchange resins but the temperature being insufficient to oxidize, fuse, melt or combust the ion exchange resins or seal the pores thereof;

(b) maintaining the resins in the drying zone for from about 3 to about 12 seconds;

(c) removing the resins from the drying zone; and (d) further treating the dried resins according to steps (a) and (b) of claim 1.

6. The process of claim 3 in which the resin particles are maintained in the drying zone at a temperature in the range of from about 200° C. to about 450° C.

7. A process for removing water from within the pores of spent, contaminated radioactive ion exchange resins and encasing radionuclides contained within the pores of said resins, in which the resins have a mean diameter of from about 5 microns to about 1000 microns and the radionuclides contained within the pores thereof are selected from the group consisting of the radionuclides $Cs^{137}$, $Co^{58}$, $Co^{60}$ or $I^{129}$ and mixtures thereof, the process consisting essentially of the sequential steps of:

(a) heating said ion exchange resins to seal the particle pores of said ion exchange resins by heating the ion exchange resins for from about 46 to about 610 hours at a temperature at which the pores of the resins are sealed while avoiding any fusing or melting of the ion exchange resins and thereby encasing radionuclides within the pores thereof; and (b) cooling the resins to obtain dry, flowable ion exchange resins having radionuclides encased within the sealed polymeric sphere.

8. The process of claim 7 which further includes the step of dewatering interstitial and surface water of the ion exchange resins.

9. The process of claim 7 which further includes the step of dehydrating residual surface and pore water of the ion exchange resins.

10. The process of claim 8 in which the dewatering step consists essentially of mechanically removing interstitial and surface water.

11. The process of claim 9 in which the dehydrating step consists essentially of:

(a) introducing spent, contaminated radioactive ion exchange resins into a drying zone and heating the resins to a temperature which vaporizes residual surface water but the temperature being insufficient to oxidize, melt, fuse or combust the ion exchange resins or seal the pores thereof;

(b) maintaining the resins in the drying zone for from about 3 to about 12 seconds;

(c) removing the particles from the drying zone; and (d) further treating the dried resins according to steps (a) and (b) of claim 7.

12. The process of claim 11 in which the resins are maintained in the drying zone at a temperature in the range of from about 200° C. to about 450° C.

* * * * *